US005883647A

United States Patent [19]

Uchida

[11] Patent Number: 5,883,647

[45] Date of Patent: Mar. 16, 1999

[54] INK JET RECORDING APPARATUS HAVING AN IMPROVED CAPPING MECHANISM

[75] Inventor: Haruo Uchida, Yokohama, Japan

[73] Assignee: Canon Kabushiki Kaisha, Tokyo, Japan

[21] Appl. No.: 610,830

[22] Filed: Mar. 12, 1996

Related U.S. Application Data

[62] Division of Ser. No. 5,982, Jan. 13, 1993, Pat. No. 5,517, 219.

[30] Foreign Application Priority Data

Jan. 16, 1992 [JP] Japan ..... 4-025729
Jan. 16, 1992 [JP] Japan ..... 4-025730

[51] Int. Cl.[6] ..... B41J 2/165

[52] U.S. Cl. ..... 347/29; 347/32

[58] Field of Search ..... 347/22, 23, 29, 347/30, 32, 36

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,567,494 | 1/1986 | Taylor | 347/30 |
| 4,587,535 | 5/1986 | Watanabe | 347/23 |
| 4,608,577 | 8/1986 | Hori | 347/66 |
| 4,723,129 | 2/1988 | Endo et al. | 347/56 |
| 4,728,970 | 3/1988 | Terasawa | 347/30 |
| 4,739,340 | 4/1988 | Terasawa | 347/30 |
| 4,740,796 | 4/1988 | Endo et al. | 347/56 |
| 4,745,414 | 5/1988 | Okamura et al. | 347/30 |
| 4,853,717 | 8/1989 | Harmon et al. | 347/29 |
| 4,970,534 | 11/1990 | Terasawa et al. | 347/32 |
| 5,086,305 | 2/1992 | Terasawa | 347/30 |
| 5,252,993 | 10/1993 | Tomii et al. | 347/32 |
| 5,260,724 | 11/1993 | Tomii et al. | 347/32 |
| 5,717,444 | 2/1998 | Sugimoto et al. | 347/29 |

FOREIGN PATENT DOCUMENTS

| | | |
|---|---|---|
| 0398347 | 11/1990 | European Pat. Off. . |
| 0436756 | 7/1991 | European Pat. Off. . |
| 0475424 | 3/1992 | European Pat. Off. . |
| 0494674 | 7/1992 | European Pat. Off. . |
| 54-056847 | 5/1979 | Japan . |
| 59-123670 | 7/1984 | Japan . |
| 59-138461 | 8/1984 | Japan . |
| 60-071260 | 4/1985 | Japan . |

*Primary Examiner*—Benjamin R. Fuller
*Assistant Examiner*—Craig A. Hallacher
*Attorney, Agent, or Firm*—Fitzpatrick, Cella, Harper & Scinto

[57] ABSTRACT

In an ink jet recording apparatus having a recording head, a cap for enclosing the ink discharge port is made of elastic material and is connected via a tube to a pump or waste ink treating member. The cap and tube are guided so that they may move in forward and backward directions with respect to the recording head; deformation of the cap and tube in other directions is prevented.

4 Claims, 10 Drawing Sheets

INK JET RECORDING APPARATUS HAVING AN IMPROVED CAPPING MECHANISM

This application is a division, of application Ser. No. 08/005,982 filed Jan. 13, 1993 U.S. Pat. No. 5,517,219.

BACKGROUND OF THE INVENTION

1. Field of the Invention

The present invention relates to an ink jet recording apparatus for recording by discharging ink from recording means onto a recording medium.

2. Related Background Art

A recording apparatus having the feature of a printer, a copying machine, or a facsimile apparatus, or a recording apparatus for use as the output device from complex electronic equipment including a computer or word processor, or a work station is constituted to record an image onto a recording sheet (recording medium) such as a paper or plastic thin plate, based on image information. Such recording apparatuses can be classified as ink jet systems, wire dot systems, thermal systems and laser beam systems.

In a recording apparatus of the serial type based on the serial scan method of scanning in a direction transverse to a conveying direction (sub-scan direction) of a recording medium, recording is performed on the recording medium by repeating an operation of recording (or scanning) the image with recording means (typically mounted on a carriage) movable along the recording medium, after setting the recording medium at a predetermined recording position, feeding a sheet (or conveying the recording medium) by a predetermined amount after terminating the recording of one line, and then again recording (or scanning) the image at the next line on the recording medium which is stopped. On the other hand, in a recording apparatus of the line type in which the recording is conducted only by sub-scanning in a conveying direction of the recording medium, recording is performed on a recording medium by repeating an operation of setting the recording medium at a predetermined recording position, recording one line collectively, feeding a sheet (or conveying the recording medium) by a predetermined amount, and further recording the next line collectively.

Among the above recording apparatuses, a recording apparatus of the ink jet system (an ink jet recording apparatus) performs recording by discharging the ink from recording means (recording head) onto a recording medium, having the advantages in which the recording means can be made compact, a high definition image can be recorded at a high speed, the ordinary paper is usable for recording without needing of any special treatment, the running cost is low, little noise is produced owing to the non-impact method, and the color image is easily recorded by using color inks. And a line-type, recording apparatus using recording means of the line type in which a number of discharge ports are arranged in a direction of the sheet width, allows for a higher speed recording.

In particular, recording means (recording head) of the ink jet system of discharging the ink by the use of heat energy can be easily fabricated with an arrangement of liquid channels (discharge ports) at a high density by forming electricity-heat converters, electrodes, liquid channel walls, and a ceiling plate as the film on a substrate through a semiconductor fabrication process such as etching, vapor deposition or sputtering, thereby allowing for a more compact configuration. On the other hand, there are a variety of requirements for the material of which the recording medium is composed, and in recent years, besides a paper or resin thin plate (e.g., OHP) which is an ordinary recording medium, the use of a thin paper or processed paper (punched paper for filing, scored paper, or any shaped paper) has been demanded.

In the above-described ink jet recording apparatus, capping means is used to enclose a discharge port area so that discharge ports are shielded from the outside, in order to prevent the occurrence of clogging due to the increase of viscosity or fixedly deposited ink produced by the drying of ink around the discharge port area of the recording means (recording head), or a suction recovery operation of compulsorily discharging the ink through discharge ports is enabled by applying a predetermined pressure (including a negative pressure) to the discharge port in order to remove (or dissolve) the clogging caused by thickened or fixed ink, bubbles or dirt within liquid channels.

The capping means is arranged to seal the discharge port by making contact with the recording head at a position outside of the recording region (e.g., a home position of the recording head or carriage). The operation mechanism for this capping means may involve for example, moving a cap attached to a cap holder so as to make contact with the recording head by utilizing the movement of the recording head (or carriage), or advancing a cap attached on a movable cap holder so as to make contact with the recording head stopped at a predetermined position.

The above mechanism utilizing the movement of the carriage is configured in such a way that the cap holder is movably attached to holder guide (guide member) by cam means, the approaching carriage (or recording head) is caused to engage the cap holder, and the cap holder is moved toward the recording head by using a further movement of the carriage so as to place the cap into close contact with the discharge port formation face.

By the way, the contact portion of the cap at least with the recording head is made of a rubber elastic material (elastic member) to insure the sealing performance more securely. Also, the cap is connected with one end of a tube via a tube connector, the other end of the tube being connected to a suction pump, which is connected via a tube to a waste ink treating member (e.g., ink absorbing member). Thus, if a discharge failure occurs due to the clogging of the discharge port, a suction recovery operation is carried out in which the cap is brought into contact with the discharge port formation face, and then the ink is compulsorily discharged through discharge ports by applying a predetermined pressure (negative pressure) to the discharge port by means of the suction pump. To resume the recording after the suction recovery operation, the cap holder is caused to move in a direction of retracting (or separating) from the recording head, and the carriage is caused to move to the recording region if the head is of the serial type.

However, in a conventional ink jet recording apparatus, when capping the recording head with a cap made of elastic material, the cap holder may be positioned inclinedly with respect to a cap contact face (discharge port formation face) of the recording head, due to a bending reaction of the tube (such as an elastic restoring force tending to restore the bent tube to its original state), or a dimensional or mounting tolerance existing in a positioning part of the cap holder for the capping, the positioning part being located between a main body base and the holder guide (or cap holder), and a cam engaging part being located between the holder guide and the cap holder, so that the amount of penetration may vary at various portions of the cap to cause a deformation at a contact portion of the cap with the discharge port formation face, leading to a capping failure and leakage. In particular, in a recording apparatus provided with a plurality of recording heads (head elements), the amount of penetration of the cap may be different between recording heads, resulting in the higher possibility of producing the capping failure with the recording head.

If leakage occurs in the cap, the ink may be thickened or fixed so that the clogging of discharge port is likely to occur, because the discharge ports are not completely shielded from the outside air. Also, at the time of the suction recovery operation, a predetermined suction force (negative pressure) may not be obtained at the discharge port due to the leakage, so that the suction recovery can not be performed. As a countermeasure, for example, when a problem associated with the inclined positioning of the cap is caused by the bending reaction of the tube, it is contemplated to avoid the bending reaction of the tube exerting on the cap by increasing the bend radius (R) of tube by the use of a longer tube, but such a constitution has the problem of requiring more space for disposing the tube, resulting in a larger recording apparatus. Because of the increased volume of tube extending from the suction pump to the cap, there is a problem that the suction force (strength of negative pressure) becomes insufficient if using the same pump, in which in order to apply the same suction force to the discharge ports, a larger pump is required, which produces a higher cost.

Also, when a problem is caused by the dimensional or mounting tolerance in a component of the cap means, a method of adjusting the inclination of the cap holder by using a movable positioning part of holder guide has been proposed, but this method is associated with a problem of bringing about the higher price, with reduced handling capability, because of the higher costs, a larger apparatus, and the addition of an adjusting process, which are caused by the increase in the number of components.

SUMMARY OF THE INVENTION

In view of the aforementioned technical problems, an object of the present invention is to provide an ink jet recording apparatus in a simple and compact constitution, in which the discharge port can be securely sealed in a stable state without leakage by preventing the inclination of a cap due to a bending reaction of a tube, whereby a predetermined stable pressure (negative pressure) can be applied to the discharge port in the suction recovery operation, while the clogging of the discharge port due to thickened or fixed ink is prevented.

Also, it is another object of the present invention to provide an ink jet recording apparatus which can realize a stable capping state by making constant the amount of penetration of the whole cap into the recording means even when capping a plurality of recording means with a plurality of caps, irrespective of the dimensional tolerance of each portion, using a simple constitution.

It is a further object of the present invention to provide an ink jet recording apparatus having a cap constitution which can realize reliable capping by accomplishing an effective capping state even when there is a complex of problems.

It is another object of the present invention to provide an ink jet recording apparatus for recording by discharging ink from recording means to a recording medium, wherein a cap for enclosing the discharge port of recording means, which is attached to a cap holder, is brought into contact with the recording means, with the cap holder being swingable about a fulcrum at a position corresponding to a substantially central portion of the recording means.

It is another object of the present invention to provide an ink jet recording apparatus having a constitution, in addition to the above-mentioned constitution, in which the recording means comprises a plurality of recording heads of different colors, and a plurality of caps each corresponding to each recording head are attached to the cap holder, or in which the discharge port of the recording means is sealed by utilizing the movement of a carriage having recording means mounted thereon in the non-recording region, in such a way that the cap holder is moved and guided by a guide member in a region where the cap is not in contact with the recording means, and after the cap is placed into contact with the recording means, the cap holder is equalized to the recording means around a fulcrum of the guide member.

Also, it is another object of the present invention to provide an ink jet recording apparatus for recording by discharging the ink from recording means to a recording medium, in which a cap made of an elastic material for enclosing the discharge port is connected directly or via a connector member with a tube for conducting the ink discharged through the discharge port to a pump or a waste ink treating member, and in which the cap, the connector member or the tube is guided by guide means which permits the movement in the forward and backward directions relative to recording means, while preventing fluctuation or deformation in any other direction that the forward and backward directions.

It is a further object of the present invention to provide an ink jet recording apparatus for recording by discharging the ink from recording means to a recording medium, in which a cap for enclosing the discharge port of the recording means, which is attached to a cap holder, is brought into contact with recording means, with the cap holder being swingable about a fulcrum at a position corresponding to a substantially central portion of the recording means, in which the cap is connected directly or via a connector member with a tube for conducting the ink discharge through the discharge ports to a pump or a waste ink treating member, and in which the cap, the connector member or the tube is guided by guide means which permits the movement in the forward and backward directions relative to recording means, while preventing fluctuation or deformation in any other direction than the forward and backward directions.

DETAILED DESCRIPTION OF THE PREFERRED EMBODIMENTS

Figure 1:
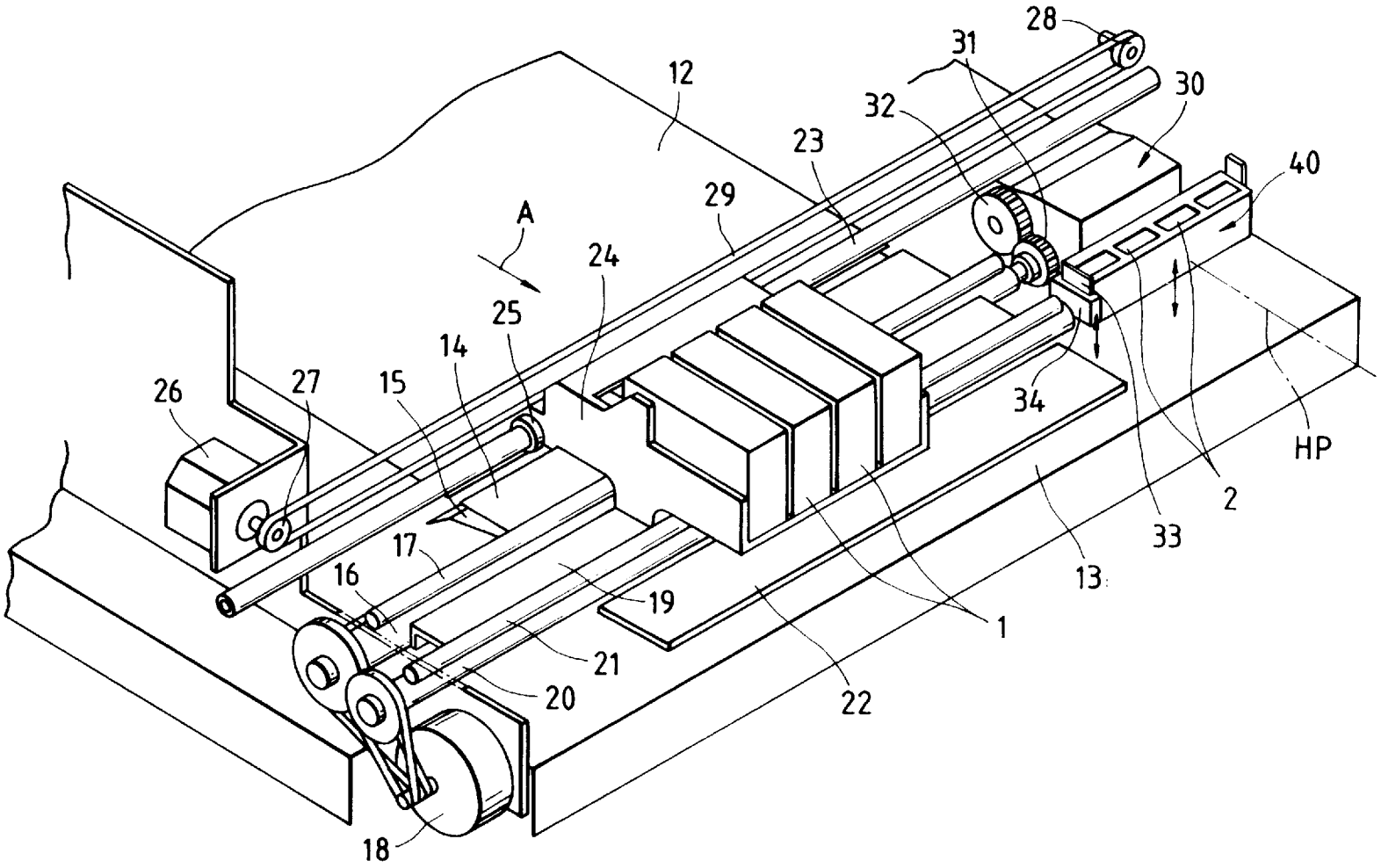
FIG. 1 is a schematic perspective view illustrating essential parts of an embodiment of an ink jet recording apparatus to which the present invention is applied.

The embodiments of the present invention will be described below with reference to the drawings. It should be noted that like numerals refer to like or corresponding parts throughout the drawings. FIG. 1 is a perspective view illustrating essential parts of an embodiment of an ink jet recording apparatus to which the present invention is applied. The ink jet recording apparatus as illustrated in FIG. 1 is configured to perform the recording by feeding intermittently a recording medium 12 in a predetermined direction by the action of a conveying (sub-scanning) mechanism, while driving (scanning) recording means (recording head) 1 in a direction transverse to that direction. Also, the recording means 1 is comprised of four head elements (recording heads) 1 of different color inks.

In FIG. 1, the recording medium 12 of a paper or plastic thin plate is conveyed in a direction of the arrow A by paper supplying means, not shown, to be introduced between an upper guide 14 and a lower guide 15 which are fixed to a bottom plate 13. Further, the recording medium 12 is guided in an advancing direction by both guides 14, 15 to enter between a pair of conveying rollers consisting of a conveying roller (sub-scan roller) 16 and a conveying driven roller (sub-scan driven roller) 17. The pair of conveying rollers 16, 17 are driven for rotation by a conveying motor 18. By controlling the driving for the pair of conveying rollers 16, 17, the recording medium 12 is carried onto a platen 19 secured to the bottom plate 13 to enter between a pair of exhausting rollers consisting of a paper exhausting roller 20 and a paper exhausting driven roller 21, while being supported by the platen 19, and is once stopped therein. The pair of paper exhausting rollers 20, 21 are driven synchronously with the pair of conveying rollers 16, 17 by the conveying motor 18.

On the bottom plate 13, a paper exhausting guide 22 is supported, whereby the recording medium 12 conveyed in the direction of the arrow A by the pair of paper exhausting rollers 20, 21 is exhausted out of a main body of the apparatus while being guided by the paper exhausting guide 22. The conveying roller 16 and the paper exhausting roller 20 have their surfaces coated with aluminum grains having a grain size of 1000 to 2000, and the surfaces of driven rollers 17, 21 have a chloroprene rubber bonded thereto. Therefore, the recording medium 12 can be conveyed by a high conveying force and with a high precision.

Backward of and above the platen 19, a scan rail (guide rail) 23 is installed in parallel to an axial direction of the conveying roller 16. The recording means 1 is mounted on the carriage 24, which is movable along the guide rail 23, with the guide rail 23 inserted through its bearing portion 25. The recording means mounted on the carriage 24 in this embodiment is constituted of a plurality of (four) recording means (head elements) with different ink colors, wherein in the full-color recording, four inks, for example, black, cyan, magenta, and yellow, are used. Each recording head (head element) 1 in this embodiment is a cartridge-type with an ink tank and a recording unit (ink discharge portion) integrated, and is positioned and secured exchangeably on the carriage 24.

Below each recording means 1 is provided the ink discharge portion (discharge port formation face) which is formed with a plurality of discharge ports arranged in a direction crosswise to the moving direction of the carriage 24. Each ink discharge portion is disposed to discharge the ink toward the side of the platen 19 through an opening portion below the carriage 24.

The recording means (recording head) 1 is an ink jet recording means which discharges the ink by the use of heat energy, comprising electricity-heat converters for generating the heat energy. Also, the recording head performs the recording by discharging the ink by the use of pressure difference arising by growth and shrinkage of bubbles due to film boiling caused by the heat energy applied by the electricity-heat converters.

Figure 2:
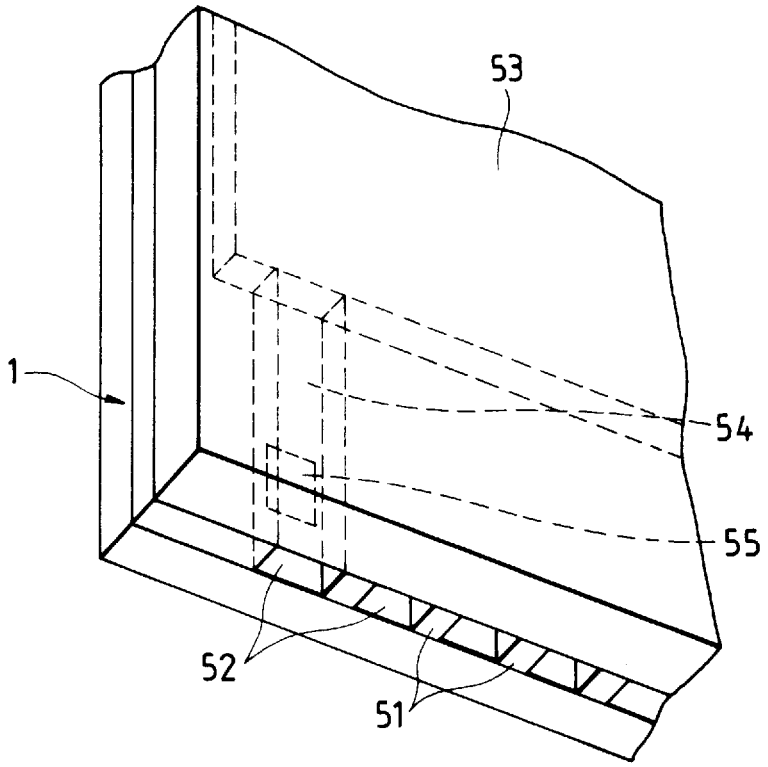
FIG. 2 is a partial perspective view illustrating schematically the structure of an ink discharge portion of recording means as illustrated in FIG. 1.

FIG. 2 is a partial perspective view illustrating schematically the structure of the ink discharge portion of a certain recording means (any one of recording means) 1. In FIG. 2, on the discharge port formation face 51 confronting the recording medium 12 spaced by a predetermined gap (e.g., about 0.5 to 2.0 millimeters), a plurality of discharge ports 52 are formed at a predetermined pitch, with electricity-heat converters (e.g., heat generating resistors) 44 for generating the energy for ink discharge each disposed along a wall surface of each liquid channel 54 communicating a common liquid chamber 53 to each discharge port. In this embodiment, the recording head 1 is mounted on the carriage 24 in such positional relation that the discharge ports 52 are arranged in a direction crosswise to the moving direction (scanning direction) of the carriage 24. Thus, a recording means (recording head) 1 is constituted which discharges the ink through the discharge port 52 by the use of pressure produced by driving (or energizing) corresponding electro-thermal converters 55 in accordance with an image signal or discharge signal and causing the film boiling in the ink within liquid channels 54.

In FIG. 1, a carriage motor (scan motor) 26 as a driving source for reciprocatingly moving the carriage 24 is fixed to a main body (e.g., side plate) of the apparatus. A motor pulley 27 is secured to a rotational shaft of the carriage motor 26, and is rotatable integrally along with the rotational shaft. On the opposite side of the motor pulley 27, there is an idler pulley 28 supported in the bearing, and a scan belt (carriage driving belt) 29 is tautly strung between the motor pulley 27 and the idler pulley 28. The carriage 24 is connected to the carriage driving belt 29 so as to be driven in reciprocating motion with positive rotations of the carriage motor 26.

At a position within a movable range of the carriage 24 and outside the recording region (or platen 19), a home position HP of the carriage is set. Near the home position HP, capping means 40 is disposed having a plurality of (four) caps 2 made of a rubber elastic material which can sealingly enclose (cap) the discharge port 52 by coming into direct (or close) contact with the discharge port formation face 51 of each recording head 1. Near this capping means 40, a recovery device 30 for dissolving discharge failure due to clogging of the discharge port 52 of each recording head 1 is disposed. This recovery device 30 is configured to produce a negative pressure with the caps through a tube by means of a suction pump to suck alien substances such as bubbles, fixed ink, and dirt together with the ink, in a state (capping state) where the discharge port 52 is enclosed by the cap 2.

Note that a roller (not shown) is rotatably borne on the bottom portion of the carriage 24, whereby as the roller rolls on the upper face of a recording medium 12 placed on the platen 19, the spacing between the discharge port formation face 51 of each recording head 1 and the record surface of recording medium 12 is regulated to be constant at all times. Since the cap 2 is disposed near the home position HP of the carriage 24, the platen 19 can not be extended to the home position HP. Therefore, if the carriage 24 moves toward the home position HP, the roller of the carriage will get out of the platen 19. Thus, at the position outside the platen 19, the carriage 24 rides via the roller on a guide plate (not shown) provided on the recovery device 30.

In recording operation, by driving the recording head 1 in accordance with an image signal as well as moving the carriage 24 with the carriage motor 26, one line of images is formed by discharging the ink on the recording medium 12 stopped on the platen 19 (main scan). If one line of recording is ended, a pair of conveying rollers 16, 17 are rotated by a predetermined amount to convey the recording medium 12 by a predetermined amount (for example, an amount corresponding to a height of one line) (sub-scan), and the next line is recorded by driving the carriage 24 and the recording head 1 again (main scan). Then, by repeating the main scan and the sub-scan alternately, the whole image is recorded on the recording medium 12. And if a trailing end of the recording medium 12 is sensed by a sensor (not shown) placed at a predefined position, the recording operation is terminated, and the recording medium 12 is exhausted out of the apparatus along the paper exhausting guide 2 with the rotation of a pair of paper exhausting rollers 20, 21.

Four recording means 1 are each composed of an ink tank portion storing a respective ink of yellow, magenta, cyan and black, and an ink discharge portion (recording head portion) for discharging the ink, each ink tank portion connected to each ink discharge portion exchangeably in a unit or individually. Each of the four color inks is discharge, from each ink discharge portion (recording head portion) in accordance with each image signal that has been color decomposed, and a full-color image is formed by superimposing images of these four colors. Note that the recording medium 12 is supplied not only from a paper supply device, but also by a method (manual insertion) in which a recording medium is inserted into a contact portion between a pair of paper exhausting rollers 20, 21 by the operator, then once conveyed from the paper exhausting side to the paper supply device side by reversely rotating the conveying motor 18, and again supplied from the paper supply device side.

Each cap 2 of the capping means 40 is designed to retain the interior of the discharge port 52 of each recording means 1 in a wet state to prevent the clogging of the discharge port 52 due to drying or fixing of the ink. Inside the recovery device 30, there is provided a suction pump (not shown), to which the interior of each cap 2 is connected via a tube. And by driving the suction pump in a state (capping state) where the discharge port 52 is sealed with the discharge port formation face 51 of each recording head 1 enclosed by each cap 2, a negative pressure is exerted on respective discharge port 52, and impurities such as bubbles, fixed inks and dirt arising within the discharge port 52 are sucked away together with the ink, so that the discharge failure is prevented.

Between the recording region (region of platen 19) and the capping means 40, there is disposed a cleaning member 33 composed of a blade of a rubber elastic material to wipe off alien substances (adherent substances) such as ink droplets or dirt adhering to the discharge port formation face 51 of each recording head 1. This cleaning member 33 is configured to be held on a holder 34, and is movable between a projected position in which it is capable of rubbing against the discharge port formation face 51 and a retracted position separated from the discharge port formation face 51 by a driving source, not shown.

Figure 3:
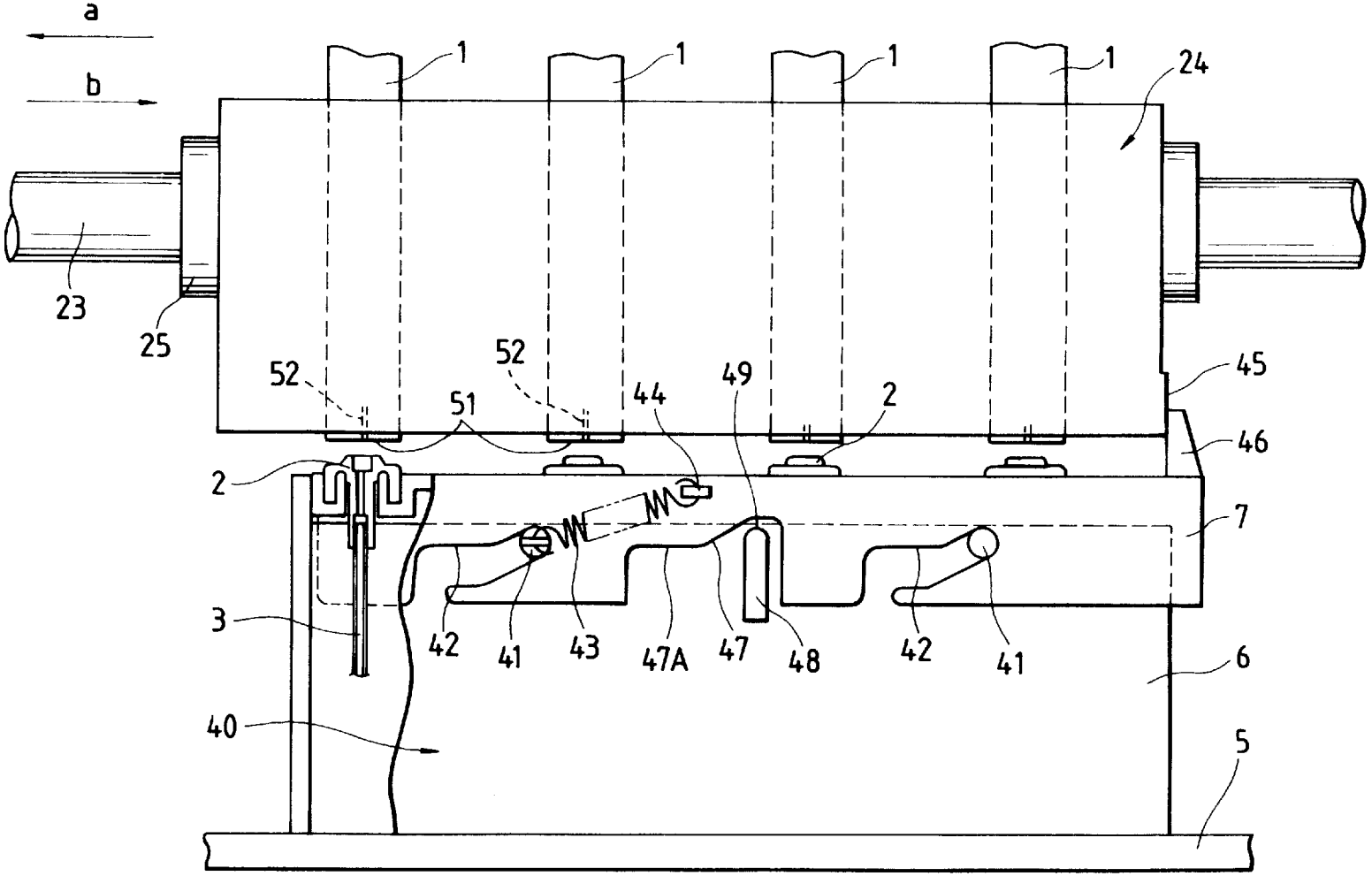
FIG. 3 is a partial elevational view, partially broken away, illustrating an embodiment of capping means to which the present invention is applied, in an open state of the cap.
Figure 4:
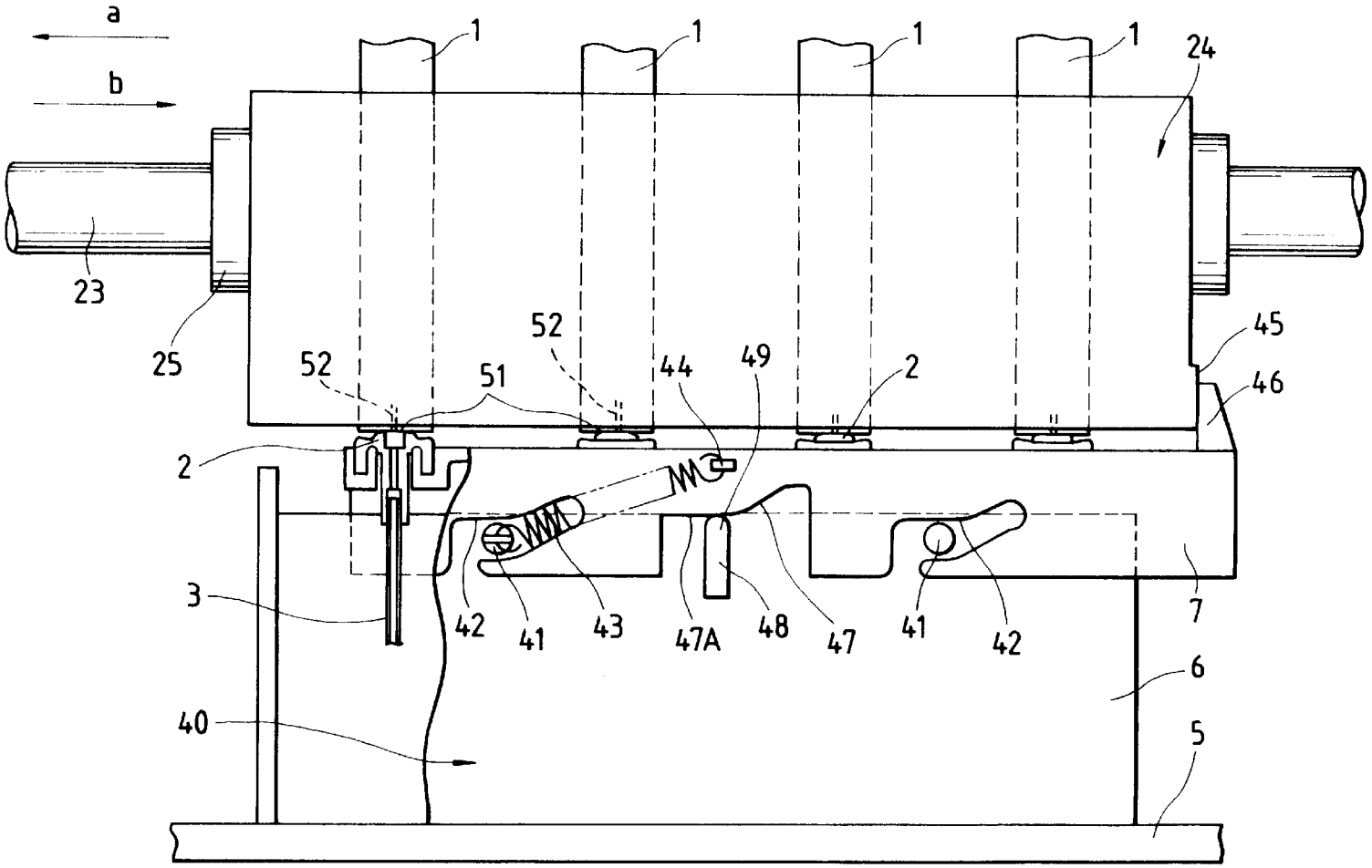
FIG. 4 is a partial elevational view, partially broken away, illustrating a capping state of capping means as illustrated in FIG. 3.

FIGS. 3 and 4 are elevational views illustrating the constitution of capping means 40 in an embodiment of an ink jet recording apparatus to which the present invention is applied, in which FIG. 3 illustrates an open state of capping means separated from the recording head 1, and FIG. 4 illustrates a capping state with the capping means placed in contact with the recording head 1. In FIGS. 3 and 4, the capping means 40 comprises a guide member (holder guide) 6 positioned and fixed on a base of the main body, a cap holder 7 held on the guide member 6, and a plurality of caps (four in this embodiment) attached on the cap holder 7. Each cap 2 is formed of a rubber elastic material at least on a contact portion thereof, and has a structure of sealing the discharge port 52 readily and stably when coming into direct (close) contact with each recording head 1.

In FIGS. 3 and 4, the cap holder 7 is carried via a cam mechanism on the holder guide 6 so as to be movable by predetermined amounts in the moving direction of the carriage 24 and in the forward and backward directions with respect to the recording head 1. This cam mechanism is comprised of projections (pins) 41 projected outwards at four positions in total on the front and back surfaces of the holder guide 6, and guide grooves 42 formed at the positions corresponding to the projections 41 of the cap holder 7. Also, the cap holder 7 is biased in leftward and downward directions as shown by a tension spring 43 with its one end attached to the holder guide 6, and normally held at a cap open position as shown in FIG. 3. Both end portions of this tension spring 43 are engaged by a spring peg 44 formed in the cap holder 7, and a spring peg provided on a projection 41 to the left side of the holder guide 6, respectively.

At an end portion to the right side of the cap holder 7, there is provided a projection (rib) 46 engageable with an end portion 45 of the carriage 24. Further, a guide portion 47 is formed substantially at a central portion of the cap holder 7 in its left and right directions, and is engageable with a projection 48 provided in the holder guide 6. The guide portion 47 and the projection 48 are normally spaced apart from each other as illustrated in FIG. 3, but in capping operation, as illustrated in FIG. 4, each cap is equalized for the sealing to the discharge port formation face 51 of each recording means 1 with the cap holder 7 swingably carried around a fulcrum at a position corresponding to a substantially central portion of the recording means 1 in the left and right directions thereof.

Each guide groove 42 of the cap holder 7 constituting the cam mechanism serves for the positioning of each projection 41 in a normal state as shown in FIG. 3, but in a capping state or substantial capping state, it is separated apart from the projection 41 as shown in FIG. 4. The position of the spring peg 44 provided on the cap holder 7 is set closer to an abutment position against a top end 49 of the projection 48 provided on the holder guide 6 so that the angular moment acting on the cap holder 7 owing to a biasing force of the spring may be as small as possible in the capping state as shown in FIG. 4.

Referring now to FIGS. 3 and 4, the operation of capping means 40 having the above constitution will be described below. The carriage 24 having four recording heads 1 mounted thereon is guided and carried along the guide rail (scan rail) 23 to be able to reciprocate in the directions of the arrows a and b. If recording is terminated, the carriage 24 is moved from the recording region in a direction of the arrow b to a position of the capping means 40 disposed in the non-recording region. And if the carriage 24 is moved to a position as shown in FIG. 3, the end portion of the carriage 24 comes into contact with the projection (rib) 46 of the cap holder 7. At this point, the cap 2 and the recording head 1 are separated from each other, but the relative position of each cap to each recording head 1 (in the left and right directions as shown) is coincident.

If the carriage 24 is further moved in a direction of the arrow b, the cap holder 7 is moved in such a way that guide grooves 42, 42 (such two guide grooves also provided on the opposite side) of the cap holder 7 are guided by projections 41, 41 (such two projections also provided on the opposite side) of the holder guide (guide member) 6. At this time, the cap holder 7 is moved in a direction of the arrow c (direction of approaching to the recording head 1), as well as in the direction of the arrow b, along with the movement of the carriage 24.

And if the cap 2 is brought into contact with the recording head 1, the cap holder 7 is moved in such a way that the top end (leading end abutting portion) 49 of the projection 48 (one projection also provided on the opposite side) of the holder guide 6 is guided by the guide portion 47 provided therein. At this time, the guide grooves 42, 42 of the cap holder 7 are gradually separated apart from the projections 41, 41 of the holder guide 6, so that the positioning of the cap holder 7 is transferred to a fulcrum consisting of projection 48 and guide portion 47 provided at a substantially central portion thereof.

If the carriage 24 is further moved in the direction of the arrow b, each cap 2 is eventually brought into close contact with each recording head 1 (or discharge port formation face 51) as illustrated in FIG. 4, forming a sealed state by applying a predetermined capping pressure thereto with elastic deformation of each cap 2, and completing the capping to shield the discharge port 52 of each recording head 1 from the outside air.

In this capping state, a flat portion 47A of the guide portion 47 and a top end portion of the projection 48 are contacted, with the cap holder 7 being swingable around the top end portion 49 around a fulcrum, as illustrated in FIG. 4, whereby the amount of penetration of each of a plurality of (four) caps 2 into each recording head 1 can be made uniform as a whole, so that the stable capping is attained owing to this equalization. The release of capping can be performed automatically only by moving the carriage 24 in the direction of the arrow a from the capping state as illustrated in FIG. 4. That is, if the carriage 24 is moved in the direction of the arrow a, the cap holder 7 is moved to the left side in the figure by the biasing of a return spring (tension spring) 43 tending to return to the normal position (separated position) of FIG. 3 while being guided by the projection 41 and the guide groove 42.

Note that in order that the cap holder 7 may be swingable to the recording head 1 in the capping state, the left-hand groove width of guide grooves 42, 42 of the cap holder 7 is larger than the outer diameter of projections 41, 41 of the holder guide 6 so that the cap holder 7 is not impeded from swinging. The positional relation between the top end portion 49 of projection 48 serving as a fulcrum in the capping state and a plurality of caps 2 is preferably such that the fulcrum 49 is provided at a substantially central portion between two caps 2, 2 attached to the both outer sides of the cap holder 7. With such an arrangement, it is possible to increase the equalizing feature and thus the capping performance.

Further, the mounting position and orientation of the return spring 43 for biasing the cap holder 7 to the open position of FIG. 3 is preferred to be selected in such a way that near the fulcrum (top end portion 49 of projection 48) in the capping state, as previously described, the angular moment acting on the cap holder 7 in the capping state is as small as possible.

Note that when clogging has occurred or may occur in the discharge port 52 of recording head 1, a suction recovery operation of compulsorily discharging the ink through the discharge port is carried out by activating the suction pump of recovery device 30 in the capping state to exert a predetermined negative pressure on the discharge port 52 via a tube 3 connection to the back side of each cap 2.

According to the embodiment as above described, an ink jet recording apparatus is provided, wherein by utilizing the movement of the carriage 24 having a plurality of recording heads 1 mounted thereon in the non-recording region, the discharge port 52 of each recording head 1 is sealingly enclosed by each of a plurality of caps 2, with the cap holder 7 being swingable around the fulcrum 49 located at a substantially central portion thereof in the capping state, whereby in a region where the cap is not placed in direct contact with the recording head 1, the cap holder 7 is moved guided by guide grooves 42, 42, and after the cap 2 is placed in direct contact with the recording head 1, the cap holder 7 is equalized to the recording head 1 around the fulcrum 49, so that even when capping a plurality of recording heads 1 with a plurality of caps 2, the amount of penetration of each cap 2 into each recording head 1 can be automatically made uniform, with a simple constitution and irrespective of the dimensional tolerance of each component, so that the stable capping can be realized owing to uniform adhering forces of a plurality of caps 2.

While in the previous embodiment, the positioning of the cap holder 7 is carried out by the use of projections 41, 41 and guide grooves 42, 42, before the cap 2 comes into contact with the recording head 1, and the positioning of the cap holder 7 and the equalizing with respect to the recording head 1 are carried out by means of a fulcrum formed of a projection 48 and a guide portion 47 after the cap 2 comes into contact with the recording head 1, it will be appreciated that by omitting the projections 41, 41 and the guide grooves 42, 42 for the positioning, the positioning of the cap holder 7 and the equalizing may be conducted only by the projection 48 and the guide portion 47 disposed centrally.

Figure 5:
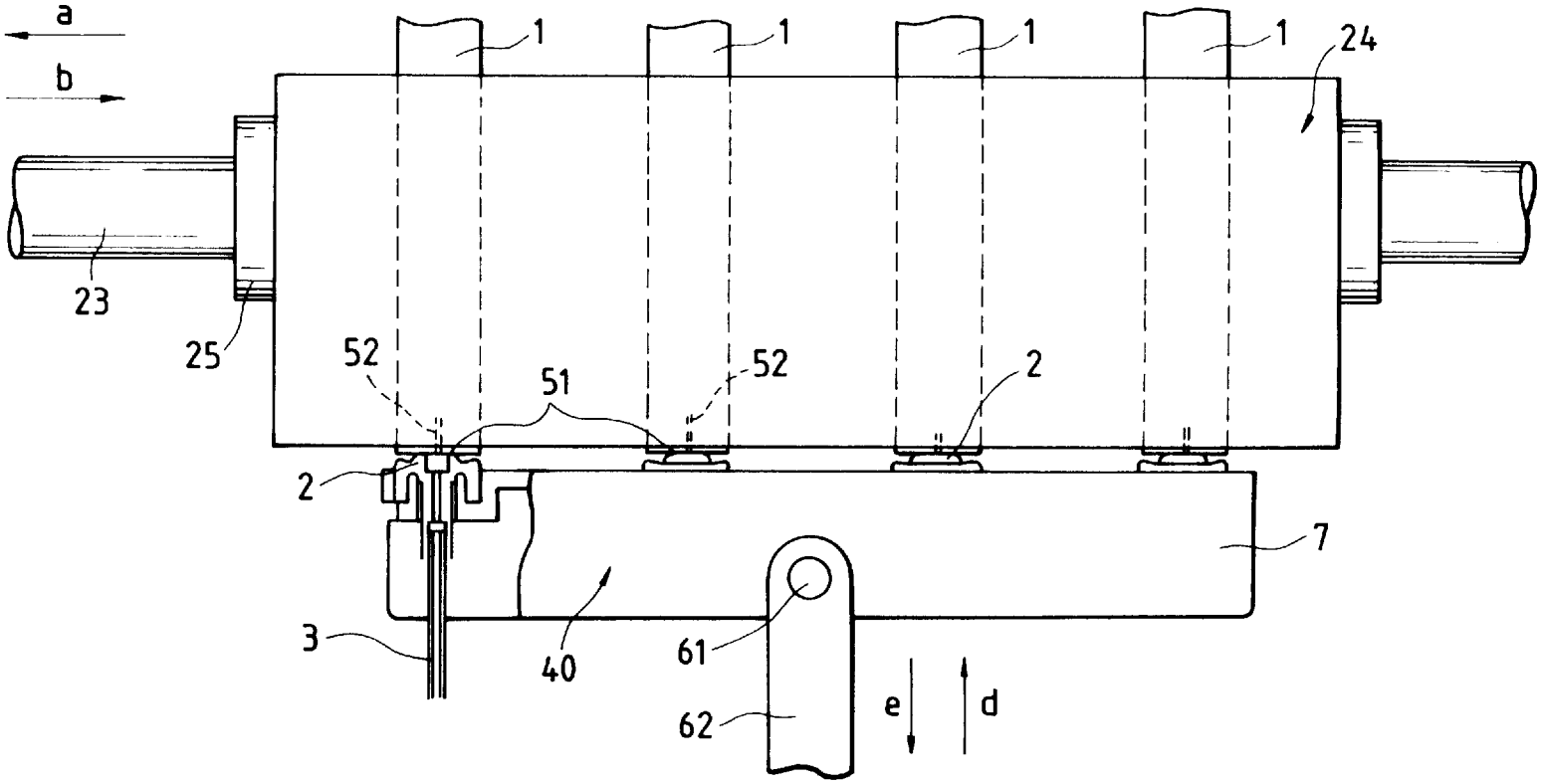
FIG. 5 is a partial elevational view, partially broken away, illustrating a capping state of capping means in another embodiment to which the present invention is applied.

While in the previous embodiment, the capping is performed by utilizing the scanning movement of the carriage to the home position, the present invention is also applicable to capping means, with the same effects, in which the cap 2 is allowed to move in perpendicular direction to the discharge port formation face 51 of the recording head 1 stopped at the home position, as illustrated in FIG. 5.

That is, in FIG. 5, a positioning pin 61 is provided at a substantially central portion of the cap holder 7 having a plurality of caps 2 mounted thereon, and the cap holder 7 is attached to a support shaft 62 so as to be swingable around the positioning pin 61. The support shaft 62 is movable in the forward and backward directions (directions as indicated by the arrows d and e) relative to the recording head 1 by a driving source, not shown. At the capping time, each cap 2 is brought into close contact with the periphery of the discharge port of each recording head 1 by moving the support shaft 61 in a direction of the arrow d. In this capping state, each cap 2 is placed in close contact with each recording head 1, with the cap holder 7 being swingable around a fulcrum 61 located at a substantially central portion of capping means 40. Accordingly, with a constitution of FIG. 5, a plurality of caps 2 can be placed in direct contact with a plurality of recording heads 1 with uniform adherent forces as a whole, irrespective of the tolerances of components, so that the capping can be stably performed in the equalized state.

Figure 6:
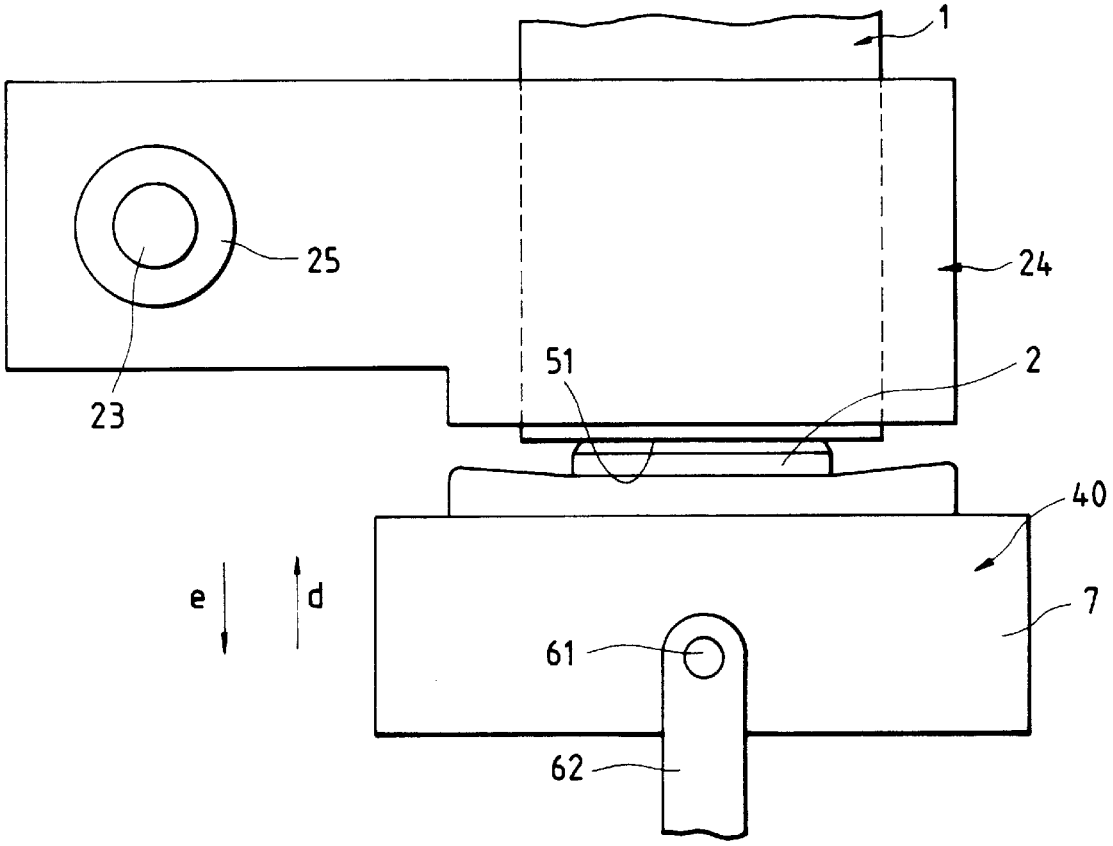
FIG. 6 is a partial side view illustrating a capping state of capping means in a still further embodiment to which the present invention is applied.

While in the embodiments as above described, the cap holder 7 is configured to be swingable within a plane in parallel to the moving direction of the carriage, because a plurality of caps are arranged in a moving direction of the carriage, the present invention is also carried out by supporting swingably the cap holder 7 within a plane crosswise (normally vertical) to the moving direction of the carriage, as illustrated in FIG. 6 FIG. 6 is a schematic constitutional view of essential parts in such an embodiment as viewed from the moving direction of the carriage.

In FIG. 6, a positioning pin 61 is provided on the cap holder 7 having one or more caps 2 mounted thereon. This positioning pin 61 is provided parallel to the moving direction of the carriage at a portion of the recording head 1 located substantially centrally in a direction of height (length in a recording medium conveying direction =sub-scanning direction). This cap holder 7 is attached to the support shaft 62 so as to be swingable around the positioning pin 61 within a plane substantially vertical to the moving direction of the carriage. The support shaft 62 is movable in the forward and backward directions (directions of the arrows d and e) relative to the recording head 1 by a driving source, not shown. At the capping time, the cap 2 is brought into close contact with the periphery of the discharge port 52 of the recording head 1 by moving the support shaft 62 in a direction of the arrow d. In this capping state, the cap 2 is placed in close contact with the recording head 1 with the cap holder 7 being swingable around a fulcrum consisting of the positioning pin 61. Accordingly, with a constitution of FIG. 6, the cap 2 can be placed in direct contact with the recording head 1 with uniform adherent forces as a whole, irrespective of tolerances of components, so that the capping is stably performed in the equalized state.

While in the previous embodiments, an ink jet recording apparatus using a plurality of recording means 1 for recording with different color inks was exemplified, the present invention is also applicable, without regards to the number of recording means, to an ink jet recording apparatus using a single recording means, or an ink jet recording apparatus for the gradation recording using a plurality of recording means for recording with the same color ink of different densities, for example, so that the same effects can be accomplished.

While in the previous embodiments, a recording apparatus of the serial type with the recording means 1 mounted on the carriage 24 was exemplified, the present invention is also applicable to a line-type recording apparatus which uses a line-type recording means of the length covering entirely or partially the recording medium 12 in its width direction, and performs the recording only by the sub-scanning, with the same effects. Further, the present invention is likewise applicable to whatever recording means 1, such as a cartridge type in which the ink discharge portion (recording head) and the ink tank portion are integrated, and a type in which the ink discharge portion (recording head portion) and the ink tank portion are separately provided, and connected via an ink supply tube, so that the same effects can be accomplished.

By the way, in order to accomplish the complete capping state, it is important not only to improve each of the cap components, but also take into consideration the state of holding the elastic cap itself, as described in the conventional art, and in particular, if the elastic restoring force of a tube connecting the cap to suction means is considered, a further secure and excellent capping state can be attained.

In the following, the improvement of the tube for connecting to suction means will be described with reference to the drawings.

Figure 7:
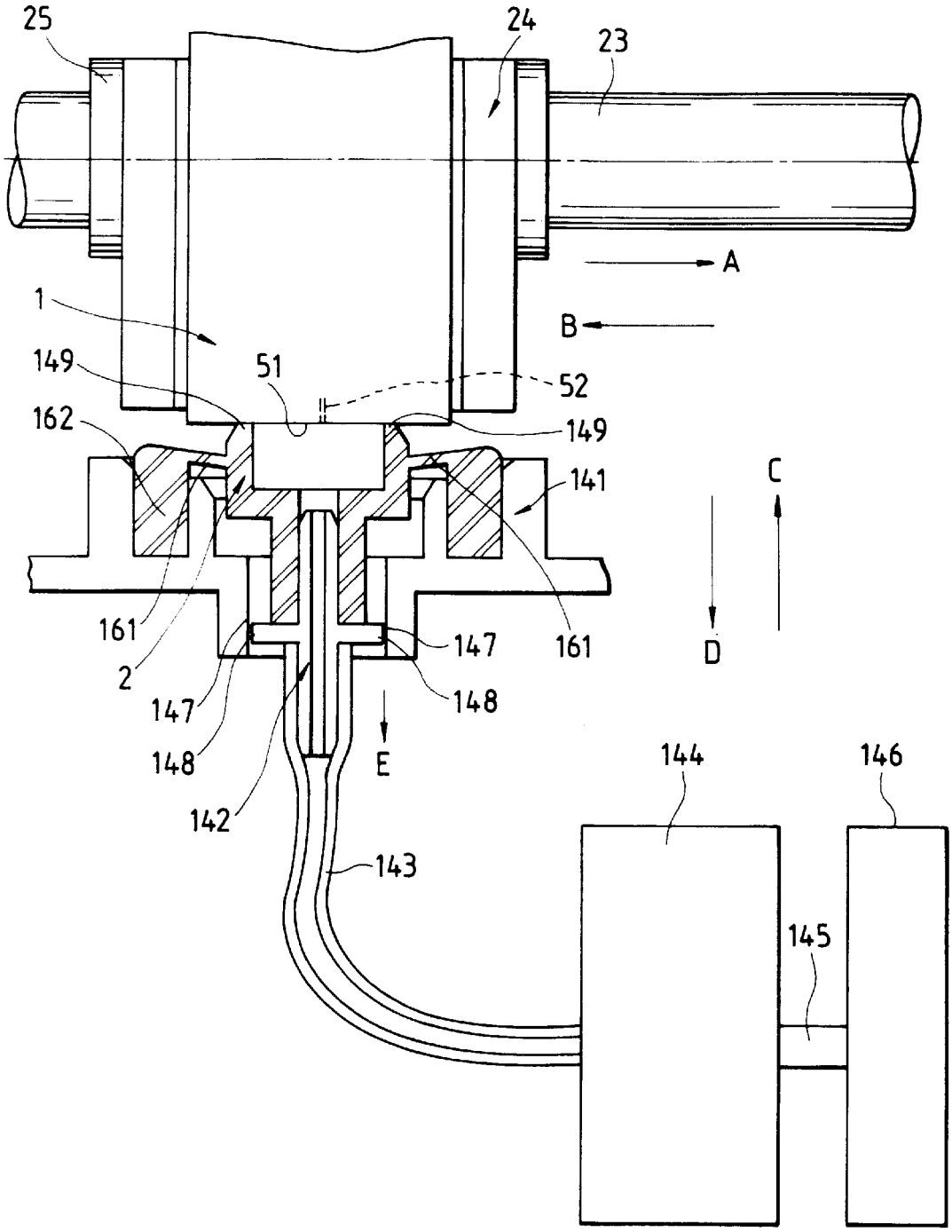
FIG. 7 is a schematic longitudinal cross-sectional view illustrating another embodiment of capping means of the ink jet recording apparatus to which the present invention is applied.

FIG. 7 is a longitudinal cross-sectional view illustrating schematically another embodiment of capping means 40 of an ink jet recording apparatus in the capping state, with an improvement in the problem associated with the connection between the cap and the tube. In FIG. 7, capping means 40 comprises a cap holder 141 movable vertically in the figure by a driving source not shown, and a cap 2 mounted on the cap holder 141. And to the back side of the cap 2 (on the opposite side of a portion thereof placed in direct contact with the recording head 1) is connected one end of a tube 143 via a tube connector 142, with the other end of the tube 143 being connected to a suction pump 144. Further, the suction pump 144 is connected via a tube 145 to a waste ink treating member 146. The tube 143, the suction pump 144 and the waste ink treating member 146 constitute a recovery device as illustrated in FIG. 1. Also, the cap 2 is formed of a rubber elastic material (elastic member) such as butyl rubber or silicone rubber so as to readily enclose the discharge port 52 when coming into contact with the discharge port formation face 51 of recording head 1.

In FIG. 7, the cap holder 141 is formed with a guide portion 147 consisting of a cylindrical hole, while the tube connector 142 is formed with a positioning portion 148 consisting of a circular overhang portion (flange portion). The guide portion 147 is formed in a direction perpendicular to the discharge port formation face 51 of recording head 1, as illustrated. And the positioning portion 148 is fitted therein in a state of being movable in an axial direction of the guide portion 147 (direction perpendicular to the discharge port formation face 51), but not swingable or deformable in other directions (different directions from a direction for coming into direct contact with recording head 1). That is, the tube connector 142 is guided and supported by the positioning portion 148 fitted with the guide portion 147, without inclination, while retaining a position normal to the recording head 1.

Further, on the outer peripheral portion of a sealing portion (a portion placed in close contact with the discharge port formation face 51) 149 of the cap 2, there is formed a thin portion with smaller thickness (thinner portion) 161, whereby the cap 2 is attached to the cap holder 141 by pressing or bonding a thick portion with larger thickness (thicker portion) 162 formed on the further outer peripheral portion around the thinner portion 161 into a fitting hole 163 of the cap holder 141. That is, the cap 2 is configured such that the thinner portion 161 is deformed in a direction of the arrow E, and owing to its reaction force, the entire periphery of the sealing portion 149 is brought into close contact with the discharge port formation face uniformly (in the equalized state) at the capping time of making contact with the discharge port formation face 51.

The operation of capping means 40 having a constitution of FIG. 7 will be described below. The carriage 24 having recording head 1 mounted thereon is guided and supported along a guide rail (scan rail) 23 so as to be movable in reciprocating motion in the directions of the arrows A and B. If recording is terminated, the carriage 24 is moved from the recording region in a direction of the arrow A toward capping means 40 disposed in the non-recording region, and stopped at a position X, where the capping of the recording means 1 is performed. Note that the present embodiment is applicable to either of the constitution of a slide-type capping as illustrated in FIG. 3 and that in which the cap itself is movable in forward or backward directions, but the latter type will be described below.

In capping operation, the cap holder 141 is moved in a direction of the arrow C by a driving source, not shown, so that the cap 2, made of an elastic material, is brought into direct (close) contact with the discharge port formation face 51 as illustrated in FIG. 7 to sealingly enclose the discharge port 52. That is, the sealing portion 149 of the cap 2 comes into contact with the discharge port formation face 51 so as to apply a predetermined pressure (welding pressure) to the sealing portion 149 due to elasticity of the cap 2 itself, and is stopped at a position to form an enclosed state for enclosing the discharge port 2. At this point, the thinner portion 161 of the cap 2 is deformed in a direction of the arrow E, and owing to its reaction force, the sealing portion 149 is equalized (to a state of establishing the uniform contact with the entire periphery) by a predetermined pressure to make contact therewith.

If clogging occurs in the discharge port in the capping state, or if it is required to prevent the occurrence of clogging, the suction recovery operation is performed. This suction recovery operation is carried out by activating the suction pump 144 to apply a negative pressure to the discharge port 52, thereby compulsorily discharging the ink from the discharge port 52. Note that if recording is resumed after the suction recovery of the discharge port, the cap 2 is retracted (separated) from the discharge port formation face 51 by moving the cap holder 141 in a direction of the arrow D by a driving source, not shown. And the carriage 24 is moved to the recording region (in a direction of the arrow B) in order to perform the recording.

With a constitution of capping means 40 as illustrated in FIG. 7, the guide portion 147 is provided in the cap holder 141, and the positioning portion 148 which can slidably fit with the guide portion 147 is provided in the tube connector 142, whereby the inclination (fluctuation) or deformation of the cap 2 and the tube connector 142 owing to a bending reaction of the tube 143 during capping can be prevented. That is, as the guide portion 147 provided on the cap holder 141 guides the movement of the cap 2 in a direction of the arrow E during the capping operation, and regulates the bending force of the tube 143, the bending reaction of the tube 143 can be securely prevented from being transmitted to the cap 2. Therefore, the setting of a small bend radius of the tube 143 is allowed, with a shorter distance between the cap 2 and the suction pump 144, whereby an ink jet recording apparatus which has accomplished a space-saving and a smaller and lighter configuration can be realized.

Figure 8:
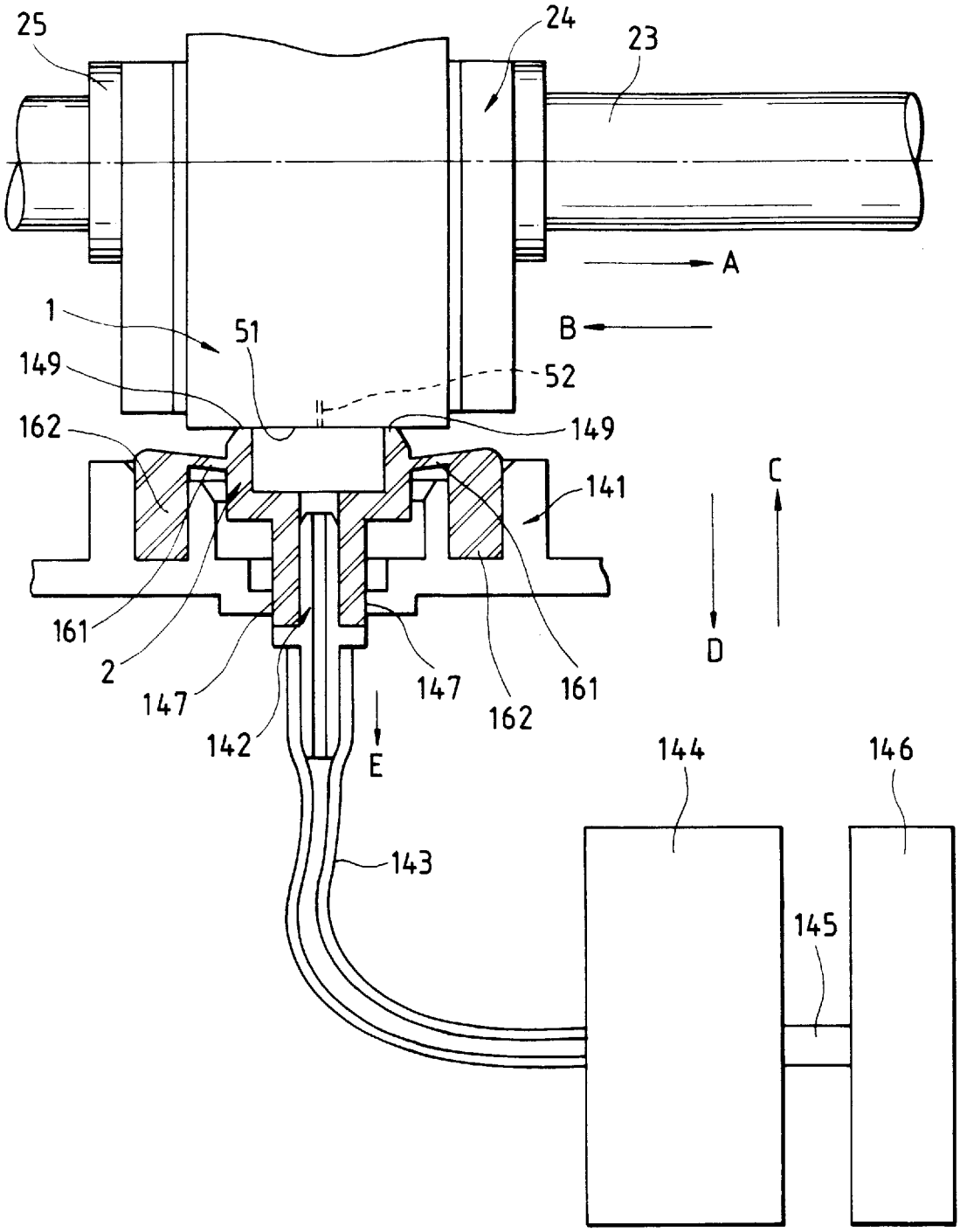
FIG. 8 is a schematic longitudinal cross-sectional view illustrating another embodiment of capping means of the ink jet recording apparatus to which the present invention is applied.

FIG. 8 is a longitudinal cross-sectional view illustrating schematically a further embodiment of capping means 40 of an ink jet recording apparatus to which the present invention is applied in the capping state. While in the previous embodiments, means for preventing the deformation or inclination of the cap 2 owing to bending reaction of the tube 143 was one of guiding the tube connector 142 with the guide portion 147 of cap holder 141 here, the cap 2 is directly guided by the guide portion 147 of the cap holder 141 in the embodiment of FIG. 8. In this case, it is preferable to guide the outer peripheral surface of a fitting portion of the tube 143 with the tube connector 142, by means of the guide portion 147, as illustrated in the figure.

Other portions of the embodiment of FIG. 8 are substantially the same as those of the embodiment of FIG. 7, wherein like numerals are used to indicate corresponding parts, and the detailed explanation thereof will be omitted. With the capping means 40 of FIG. 8, the guide portion 147 provided on the cap holder 141 guides the movement of the cap 2 in the direction of the arrow E in the capping operation and regulates the bending reaction of the tube 143, as in the embodiment of FIG. 7, so that the inclination or deformation of the cap 2 owing to the bending reaction of the tube 143 can be eliminated, thereby allowing for the setting of a small bend radius of the tube 143 and a shorter distance between the cap 2 and the suction pump 144, whereby a recording apparatus which has accomplished a space-saving and a smaller and lighter configuration is realized.

Figure 9:
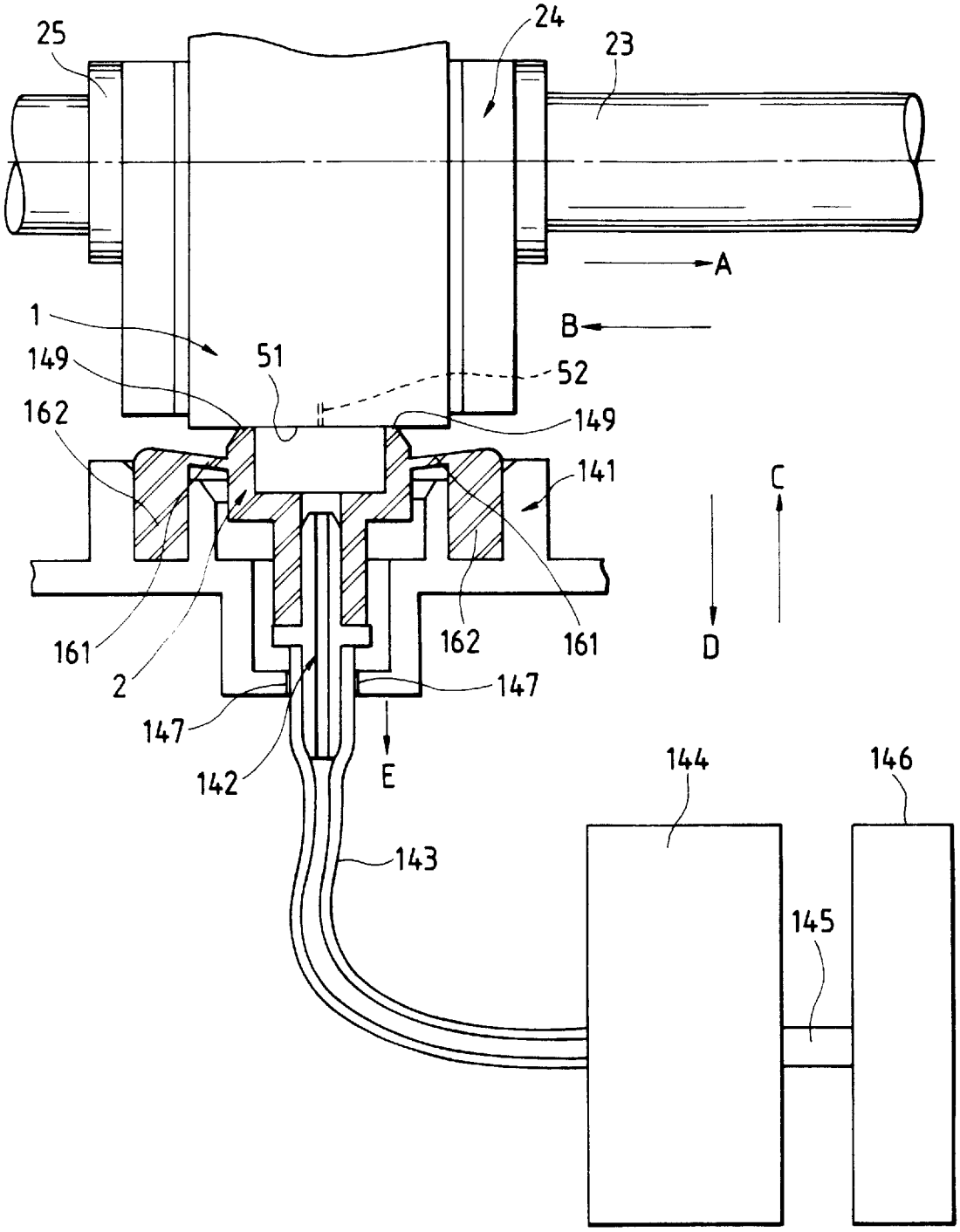
FIG. 9 is a schematic longitudinal cross-sectional view illustrating a further embodiment of capping means of the ink jet recording apparatus to which the present invention is applied.

FIG. 9 is a longitudinal cross-sectional view illustrating schematically another embodiment of capping means 40 of an ink jet recording apparatus to which the present invention is applied, in the capping state. While in the previous embodiment of FIG. 7, means for preventing the deformation or inclination of the cap 2 owing to bending reaction of the tube 143 was one of guiding the tube connector 142 with the guide portion 147 of the cap holder 141, the tube 143 is guided by the guide portion 147 of the cap holder 141 in the embodiment of FIG. 9. In this case, it is preferable to guide the outer peripheral surface of a fitting portion of the tube 143 with the tube connector 142, by means of the guide portion 147, as illustrated in the figure.

Other portions of the embodiment of FIG. 9 are substantially the same as those of the embodiment of FIG. 7, wherein like numerals are used to indicate corresponding parts, and the detailed explanation thereof will be omitted. With the capping means 40 of FIG. 9, the guide portion 147 provided on the cap holder 141 guides the movement of the cap 2 in the direction of the arrow E in the capping operation and regulates the bending reaction of the tube 143, as in the embodiment of FIG. 7, so that the inclination or deformation of the cap 2 owing to the bending reaction of the tube 143 can be eliminated, thereby allowing for the setting of a small bend radius of the tube 143 and a shorter distance between the cap 2 and the suction pump 144, whereby a recording apparatus which has accomplished a space-saving and a smaller and lighter configuration is realized.

While in the embodiments of FIGS. 8 and 9, the cap 2 and the tube 143 are connected via the tube connector 142, it will be appreciated that by omitting the tube connector 142, the cap 2 and the tube 143 may be directly connected, and the cap 2 or the tube 143 may be guided by the guide portion 147 of the cap holder 141 as a further embodiment. Such a configuration can also accomplish the same effects.

While in the above embodiments, the guide portion 147 is provided on the cap holder 141, it will be also appreciated that this guide portion 147 may be provided on another member (e.g., guide member), but not the cap holder 141.

Figure 10:
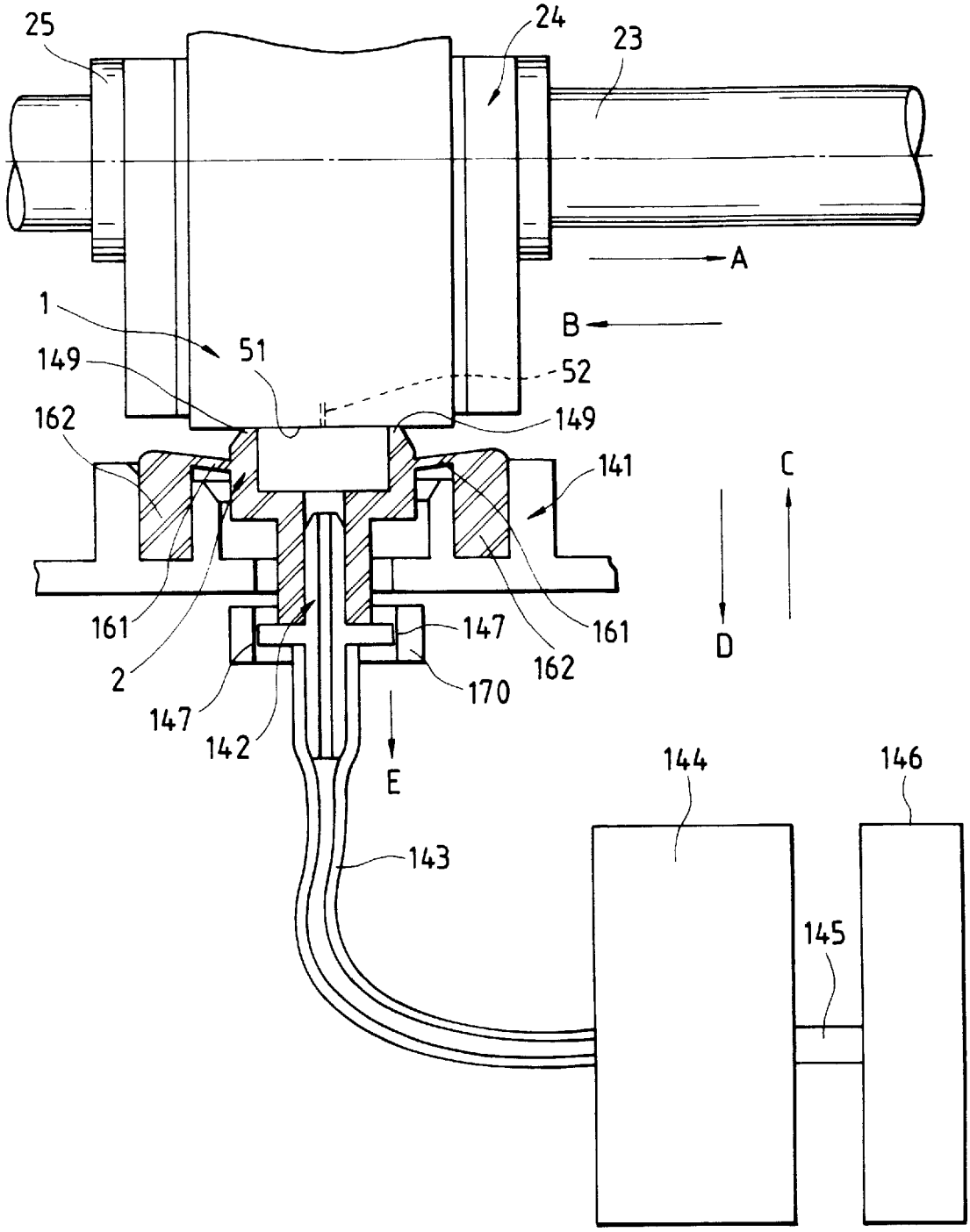
FIG. 10 is a schematic longitudinal cross-sectional view illustrating a still further embodiment of capping means of the ink jet recording apparatus to which the present invention is applied.

FIG. 10 is a longitudinal cross-sectional view illustrating schematically a constitution in which the cap holder 141 and a guide member 170 are separately formed, and a guide portion 147 is provided on the guide member 170, in the capping state. This guide member 170 is positioned and fixed in a member such as the cap holder 141 by mounting means, not shown.

The embodiment of FIG. 10 is different from that of FIG. 7 in that the guide portion 147 is provided on the cap member 170 provided apart from the cap holder 141, but is substantially of the same configuration in other portions, wherein like numerals indicate corresponding parts, and the detailed explanation thereof will be omitted. With the configuration of FIG. 10, the guide portion 147 provided on the guide member 170 guides the movement of the cap 2 in the direction of the arrow E in the capping operation and regulates the bending reaction of the tube 143, so that the inclination or deformation of the cap 2 owing to the bending reaction of the tube 143 can be eliminated as in the previous embodiments, thereby allowing for the setting of a small bend radius of the tube 143 and a shorter distance between the cap 2 and the suction pump 144, whereby a recording apparatus which has accomplished the space-saving and a smaller and lighter configuration is realized.

According to another embodiment, the guide portion 147 may be provided on a guide member (e.g., guide member 170 in FIG. 10) separate from the cap holder 141 in the embodiments of FIGS. 8 and 9. This guide member in this case is positioned and fixed in a member such as the cap holder 141 by mounting means, not shown. And such a configuration can also offer the same effects as in each of the embodiments of FIGS. 7 to 10.

According to the embodiments as above described, in a constitution in which a cap 2, made of a rubber elastic material for forming an enclosed state in the discharge port 52 portion of recording head 1, is connected directly or via a connector-member 142 to a tube 143 for conducting the ink discharged from the discharge port 52 to a pump 144 or a waste ink treating member 146, and the cap 2, the tube 143 or the connector member 142 is guided by means of the guide portion 147 so as to be movable in the forward and backward directions of the cap 2 with respect to the recording head 1, and prevent the fluctuation (inclination) or deformation in any other direction than the forward and backward directions, by preventing the inclination or deformation of the cap 2 owing to bending reaction of the tube 143, the recording head 1 can be capped in a stable state without leakage, so that it is possible to prevent the clogging due to thickened or fixed ink around the discharge port 52, and exert a predetermined stable pressure (negative pressure) on the discharge port 52 portion in the suction recovery operation.

While in the previous embodiments, an ink jet recording apparatus using a single recording means (recording head) 1 was exemplified, the present invention is also applicable, without regards to the number of recording means, for example, to an ink jet recording apparatus using a plurality of recording means for recording with different color inks, or an ink jet recording apparatus for the gradation recording using a plurality of recording means for recording with the same color ink of different densities, so that the same effects can be accomplished.

While in the previous embodiments, a recording apparatus of the serial type with the recording means 1 mounted on the carriage 24 was exemplified, the present invention is also applicable to a line-type recording apparatus which uses a line-type recording means of the length covering entirely or partially the recording medium 12 in its width direction, and performs recording only by recording in the sub-scanning direction, with the same effects. Further, the present invention is similarly applicable to whatever recording means, such as a cartridge type in which the ink discharge portion (recording head) and the ink tank portion are integrated, and a type in which the ink discharge portion (recording head portion) and the ink tank portion are separately provided, and connected via an ink supply tube, so that the same effects can be accomplished.

The present invention is applicable to an ink jet recording apparatus, for example, using recording means (recording head) with electricity-heat converters such as piezo-elements, and brings about excellent effects particularly in an ink jet recording apparatus in the method of discharging the ink with the heat energy among the various ink jet recording systems. With such a method, the higher density and higher resolution of recording can be obtained.

As to its representative constitution and principle, for example, one practiced by use of the basic principle disclosed in, for example, U.S. Pat. Nos. 4,723,129 and 4,740,796 is preferred. This system is applicable to either of the so-called on-demand type and the continuous type. Particularly, the case of the on-demand type is effective because, by applying at least one driving signal which gives rapid temperature elevation exceeding nucleate boiling corresponding to the recording information on electricity-heat converters arranged corresponding to the sheets or liquid channels holding a liquid (ink), heat energy is generated at the electricity-heat converters to effect film boiling at the heat acting surface of the recording head, and consequently the bubbles within the liquid (ink) can be formed corresponding one by one to the driving signals.

By discharging the liquid (ink) through an opening for discharging by growth and shrinkage of the bubble, at least one droplet is formed. By making the driving signals into the pulse shapes, growth and shrinkage of the bubbles can be effected instantly and adequately to preferably accomplish discharging of the liquid (ink) particularly excellent in response characteristics. As the driving signals of such pulse shape, those as disclosed in U.S. Pat. Nos. 4,463,359 and 4,345,262 are suitable. Further excellent recording can be performed by employment of the conditions described in U.S. Pat. No. 4,313,124 relating to an invention concerning the temperature elevation rate of the above-mentioned heat acting surface.

As the constitution of the recording head, in addition to the combination of the discharging orifice, the liquid channel, and the electricity-heat converter (linear liquid channel or right-angled liquid channel) as disclosed in the above-mentioned respective specifications, the constitution described in U.S. Pat. Nos. 4,558,333 or 4,459,600 disclosing the constitution having the heat acting portion arranged in the flexed region is also included in the present invention. In addition, the present invention can be also effectively made according to the constitution of Japanese Laid-Open Patent Application No. 59-123670 which disclosed a structure using a slit common to a plurality of electricity-heat converters as the discharging portion of the electricity-heat converter or Japanese Laid-Open Patent Application No. 59-138461 which discloses an opening for absorbing pressure wave of heat energy correspondent to the discharging portion. That is, the present invention makes it possible to realize the secure and efficient recording, in whatever form the recording head may be configured.

Further, as the recording head of the full line type having a length corresponding to the maximum width of a recording sheet (recording medium) which can be recorded by the recording device, the present invention can exhibit the effects as described above further effectively. As such a recording head, either the constitution which satisfies its length by a combination of a plurality of recording heads or the constitution as one recording head integrally formed may be used. In addition, among the serial-type recording heads as above described, the present invention is effective for a recording head fixed to the main device, a recording head of the freely exchangeable chip type which enables electrical connection to the main device or supply of ink from the main device by being mounted on the main device, or a recording head of the cartridge type having an ink tank integrally provided on the recording head itself.

Also, the addition of a restoration means for the recording head, a preliminary auxiliary means, etc., provided as the constitution of the recording device of the present invention is preferable, because the effect of the present invention can be further stabilized. Specific examples of these may include, for the recording head, capping means, cleaning means, pressurization or suction means, electricity-heat converters or another type of heating elements, or preliminary heating means according to a combination of these, and it is also effective for performing stable recording to perform in a preliminary mode which performs discharging separate from recording.

As for the type of recording head to be mounted or the number of recording heads, the present invention is effective for a single recording head provided corresponding to a monocolor ink or a plurality of recording heads corresponding to a plurality of inks having different recording colors or densities, for example. That is, as the recording mode of the recording device, the present invention is extremely effective for not only the recording made only of a primary color such as black, etc., but also a device equipped with at least one of plural different colors or full color by color mixing, whether the recording head may be either integrally constituted or combined in plural number.

In addition, though the ink is considered as the liquid in the embodiments as above described, another ink may be also used which is solid below room temperature and will soften or liquefy at or above room temperature, or liquefy when a recording enable signal is issued as it is common with an ink jet device to control the viscosity of ink to be maintained within a certain range of the stable discharge by adjusting the temperature of ink in a range from 30° C. to 70° C. In addition, in order to avoid temperature elevation due to heat energy by positively utilizing the heat energy as the energy for the change of state from a solid to a liquid, or to prevent the evaporation of ink by using ink which will stiffen in the shelf state, the use of ink having a property of liquefying only with the application of heat energy, such as liquefying with the application of heat energy in accordance with a recording signal so that liquid ink is discharged, or may be solidified prior to reaching a recording medium, is also applicable in the present invention.

In such a case, the ink may be held as a liquid or a solid in recesses or through holes of a porous sheet, which is placed opposed to electricity-heat converters, as described in Japanese Laid-Open Patent Application No. 54-56847 or No. 60-71260. The most effective method for the ink as above described in the present invention is based on film boiling.

Further, a recording apparatus according to the present invention may be used as an image output terminal in an information processing equipment such as a computer, a copying machine in combination with a reader, or a facsimile terminal equipment having the transmission and reception feature.

According to the present invention, there is provided an ink jet recording apparatus for recording by discharging the ink from recording means to a recording medium, in which a cap made of an elastic material for enclosing the discharge port and a tube for conducting the ink discharged from the discharge port to a pump or a waste ink treating member are connected directly or via a connector member, and in which the cap, the connector member or the tube is guided by guide means which permits the movement in the forward and backward directions which respect to the recording head and prevents the fluctuation or deformation in other directions than the forward and backward directions, whereby by preventing the inclination of the cap owing to the bending reaction of the tube, the recording head can be securely sealed in a stable state without leakage in a simple and compact configuration, so that it is possible to prevent the clogging due to thickened or fixed ink around the discharge port, and exert a predetermined stable pressure on the discharge port in the suction recovery operation.

As will be clear from the above description, according to the present invention, there is provided an ink jet recording apparatus for recording by discharging ink from recording means to a recording medium, in which a cap for enclosing the discharge port of recording means, which is attached to a cap holder can be brought into direct contact with the recording means with the cap holder being swingable around a fulcrum at a position corresponding to a substantially central portion of the recording means, whereby the amount of penetration of the whole cap into the recording means can be made uniform, even when a plurality of recording means are capped with a plurality of caps, in a configuration, and irrespective of the dimensional tolerance of each component, so that the stable capping can be realized.

Further, according to the present invention, there is provided an ink jet recording apparatus having a constitution, in addition to the above constitution, in which recording means is constituted of a plurality of recording heads for recording with different color inks, and a plurality of caps corresponding to a plurality of recording heads are attached to the cap holder, and in which by utilizing the movement of the carriage having a plurality of recording heads 1 mounted thereon in the non-recording region, the discharge port of the recording heads are sealingly enclosed, whereby in a region where the cap is not placed in direct contact with the recording heads, the cap holder is moved guided by the guide groove, and after the cap is placed in direct contact with the recording head, the cap holder is equalized to the recording head around a fulcrum of a guide member, so that even when capping a plurality of recording heads with a plurality of caps, the amount of penetration of each cap into each recording head can be made uniform to realize stable capping, in a simple configuration and irrespective of the dimensional tolerance of each component.

What is claimed is:

1. An ink jet recording apparatus for recording by discharging ink from a recording means having a discharge port to a recording medium, comprising:

a cap made of an elastic material for enclosing the discharge port;

a pump or a waste ink treating member a tube for conducting ink from the discharge port to said pump or said waste ink treating member, said tube being connected to said pump or waste ink treating member;

a connector member which connects said cap and said tube at a connecting portion; and guide means for guiding said connecting portion to permit movement thereof in forward and backward directions with respect to the recording means and to prevent fluctuation or deformation of said cap and said tube in directions other than the forward and backward directions.

2. An ink jet recording apparatus according to claim 1, wherein said recording means comprises electro-thermal convertors for generating heat energy for use in discharging the ink.

3. An ink jet recording apparatus according to claim 2, wherein said recording means discharges the ink through the discharge port by the use of film boiling occurring in the ink due to the heat energy generated by said electro-thermal convertors.

4. An ink jet recording apparatus according to claim 1, wherein the recording means comprises a plurality of recording heads for recording with different color inks, and a plurality of caps are provided corresponding to the plurality of recording heads.

* * * * *